US008328015B2

(12) United States Patent
Weissbrod

(10) Patent No.: US 8,328,015 B2
(45) Date of Patent: Dec. 11, 2012

(54) COMPRESSIBLE CONTAINER FOR ELECTRODE PACKAGING

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 74 days.

(21) Appl. No.: 12/877,526

(22) Filed: Sep. 8, 2010

(65) Prior Publication Data

US 2012/0055939 A1 Mar. 8, 2012

(51) Int. Cl.
*B65D 85/26* (2006.01)
*B65D 81/20* (2006.01)
*B65D 6/00* (2006.01)

(52) U.S. Cl. ..... 206/443; 206/524.8; 220/666; 220/669

(58) Field of Classification Search ..... 206/443, 206/446, 524.8, 526; 220/666, 667, 669–675
See application file for complete search history.

(56) References Cited

U.S. PATENT DOCUMENTS 2,390,631 A * 12/1945 Young ..... 206/443
2,685,316 A 8/1954 Krasno
3,176,504 A 4/1965 Shapiro
3,325,031 A 6/1967 Singier
3,872,994 A 3/1975 Hyde
3,887,077 A 6/1975 Frey
4,299,074 A 11/1981 Johansson et al.
4,724,974 A 2/1988 Marqua et al.
5,040,698 A * 8/1991 Ramsey et al. ..... 220/671
5,263,587 A 11/1993 Elkin et al.
5,362,776 A 11/1994 Barenberg et al.
5,413,244 A * 5/1995 Ramsey ..... 220/671
5,439,730 A 8/1995 Kelly et al.
5,788,078 A 8/1998 Fuss
5,947,282 A 9/1999 Merrill et al.
7,073,675 B2 * 7/2006 Trude ..... 220/666
7,163,123 B2 * 1/2007 Bezek ..... 220/675
7,458,480 B2 12/2008 Nguyen
7,780,004 B2 * 8/2010 Carlozzi et al. ..... 206/443
7,854,323 B2 12/2010 Weissbrod
7,866,500 B1 * 1/2011 Peggs ..... 220/666
8,069,987 B2 * 12/2011 Choy et al. ..... 206/524.8
(Continued)

FOREIGN PATENT DOCUMENTS

DE 23328630 A1 2/1985
(Continued)

OTHER PUBLICATIONS

Written Opinion of the International Preliminary Examining Authority for corresponding application PCT/IB2011/001915, dated Aug. 30, 2012.

*Primary Examiner* — Bryon Gehman
(74) *Attorney, Agent, or Firm* — Hahn Loeser & Parks LLP

(57) ABSTRACT

A container, utilized for the storage and transport of articles, includes a body comprised of one or more sidewalls drawn in a generally longitudinal fashion and two end pieces, disposed distally on either end of the container body. A plurality of ribs are disposed between the end pieces to facilitate inward compression of the container body. In his manner, the container volume can be permanently or temporarily altered to take up the tolerance between the volume of articles and the otherwise fixed volume of the package.

14 Claims, 9 Drawing Sheets

U.S. PATENT DOCUMENTS

| | | | | |
|---|---|---|---|---|
| 2004/0173613 | A1* | 9/2004 | Schroeder et al. | 220/276 |
| 2006/0261074 | A1 | 11/2006 | Nguyen | |
| 2009/0205290 | A1 | 8/2009 | Weissbrod | |
| 2010/0108698 | A1 | 5/2010 | Daliri | |
| 2011/0024417 | A1 | 2/2011 | Loukeris | |

FOREIGN PATENT DOCUMENTS

| | | |
|---|---|---|
| EP | 1785072 A1 | 5/2007 |
| FR | 2833244 A1 | 6/2003 |

* cited by examiner

COMPRESSIBLE CONTAINER FOR ELECTRODE PACKAGING

FIELD OF INVENTION

The present invention relates generally to systems and methods for packing materials in a container, and more particularly, tightly packing articles for transport.

BACKGROUND

Arc welding uses a power supply to create an electric arc between an electrode and a base material to melt metals at a welding point. Arc welding processes can employ either direct (DC) or alternating (AC) current, and consumable or non-consumable electrodes. The electrode is used to conduct current through a workpiece to fuse two pieces together. The electrode can also be consumed in some applications during the process to become part of the weld. In such an example, the electrode is generally rod-shaped to allow for a calibrated amount of material to melt per unit of energy delivered to the metal consumable. In order to enhance the weld process, electrodes are typically coupled with a flux material. In one example, the flux is disposed within a core and surrounded by metal of the rod-shaped electrode. In another example, the flux is adhered to the outer surface of the rod-shaped electrode via any number of known methods.

In order to accommodate operations at disparate geographical locations, arc welding materials are typically shipped to customers in containers of varying size and shape. Many materials are placed in crates or boxes and filled with packing material to minimize or prevent damage during shipping. In some circumstances, products are wrapped with layers of plastic material encapsulated with air, known commonly as bubble wrap, which helps protect the product from shock or impact. Other containers are filled with packing materials made from foamed polymers, such as polystyrene. These air filled "peanuts" also function to protect the packaged products by absorbing force thereby minimizing damage to the surrounding article.

In the case of welding consumables, however, electrodes are typically placed in direct contact with one another in containers. Electrodes are generally packaged within one size container based on weight. Utilizing this metric, however, can lead to inconsistent packaging as electrodes often have differing material density. Accordingly, the volume associated with the weight of electrodes within each container can vary from container to container. In one example, electrodes with a generally low material density can occupy a high volume of space within the container. In contrast, electrodes with a high average density can occupy a low volume of space within the container. In the case of low volume occupation, substantial movement of the electrodes can occur within the container, wherein flux which may be adhered to the exterior of the electrodes is scraped off, scratched or otherwise damaged during transport.

U.S. Patent Publication No. 2009/0205290, assigned to Lincoln with the same inventor as the subject application, described previous systems and methods to compensate for disparate volume on a container-by-container basis. The '290 publication describes a container insert to take up extra space that may be placed in the container intended for storage and/or shipment of material to an end user. The insert is generally longitudinal having a helical configuration that can be expanded and constricted for taking up different volumes of space within the container respective of the amount of material stored therein. The insert may also be elastically deformable or generally pliable and may absorb impact forces for preventing or minimizing damage to the material intended for shipment.

Such prior art systems and methods, however, can add unwanted expense to container costs for the transport of electrodes contained therein. Moreover, such inserts may not provide desired compensation in volume or location within the shipping container. Accordingly, what are needed are systems and methods to provide low cost volume compensation within containers to ensure that products stored therein are not damaged during transport.

SUMMARY OF THE INVENTION

A container, utilized for the storage and transport of articles, includes a body comprised of one or more sidewalls drawn in a generally longitudinal fashion and two end pieces, disposed distally on either end of the container body. A plurality of ribs are disposed between the end pieces to facilitate inward compression of the container body. In this manner, the container volume can be permanently or temporarily altered to take up the tolerance between the volume of articles and the otherwise fixed volume of the package.

DETAILED DESCRIPTION OF THE INVENTION

The systems and methods described herein relate to systems and methods for the storage and transport of articles. A container can be employed and loaded with the articles and subsequently compressed to reduce the internal volume thereof. In this manner, the articles can be relegated to a nominal displacement within the container during transport. Articles for transport can be comprised of material that can be easily damaged by contact with other articles, contact with the container and/or from sudden movement. In one example, the articles are welding electrodes that contain a layer of flux around a core. If the electrodes are allowed to move freely within the container, flux can be chipped off or removed due to contact with other electrodes, which can cause damage thereof. In welding practice, the use of a damaged electrode can be associated with inconsistent application of heat to cause substandard quality welding. The systems and methods described herein address protection of articles sensitive to deleterious effects caused while in containers during transport.

Figure 1:
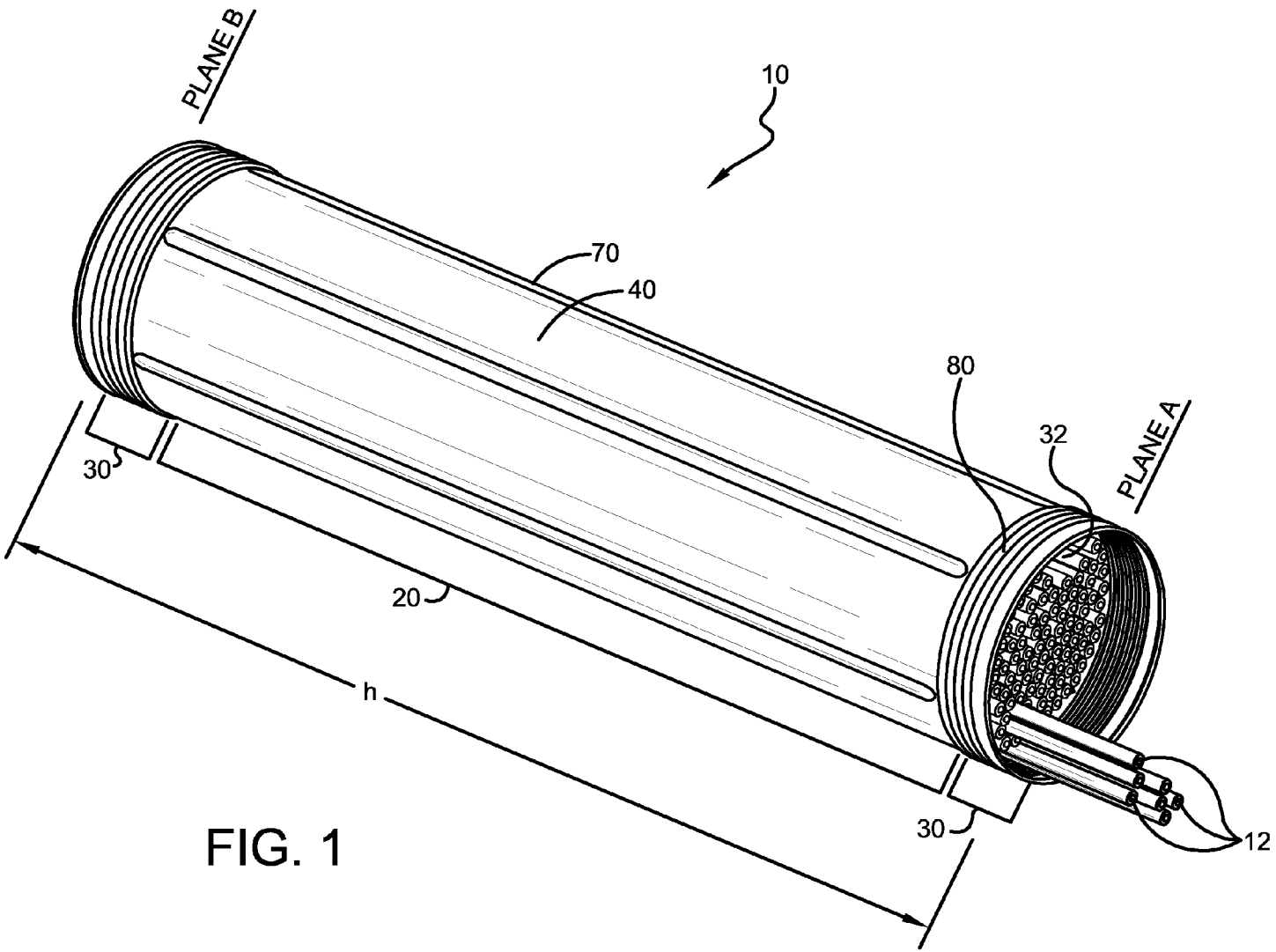
FIG. 1 is a perspective view of a container employed to store and transport articles.

Referring now to the drawings wherein the showings are for purposes of illustrating embodiments of the invention only and not for purposes of limiting the same, FIG. 1 shows a container 10 utilized for the storage and transport of articles 12. The container 10 is comprised of a body 20 disposed between two end pieces 30, which are placed distally on either end of the container 10. The body 20 can accommodate localized permanent or semi-permanent deformation at one or more locations. The end pieces 30 are each associated with an opening 32 to accommodate placement of the articles 12 within the container 10. As depicted, the end pieces 30 include hoop corrugations coupled together via a flexible material to create an accordion-like structure. Plane A and plane B are parallel and extend across each opening 32, wherein distance h between plane A and plane B is equal to the length of the body 20 and end pieces 30 together.

In this embodiment, the container 10 is cylindrical in shape and wherein the body 20 is drawn in a generally longitudinal fashion. It is to be appreciated, however, that the container 10 and associated embodiments can be of substantially any size or shape. In one application, the container 10 is utilized to hold rod-like components, such as welding electrodes. The container 10, however, can be designed to hold substantially any type of article as appropriate for use with the embodiments of the subject invention. The end pieces 30 can each provide structure to insure that the openings 32 maintain substantially the same shape both prior and subsequent to deformation of the body 20.

A sidewall 40 can be employed to fabricate the body 20 and end pieces 30 as a generally unitary structure. In one approach, the sidewall 40 is a generally rigid material, such as a metal, an aluminum, an alloy, a non-resiliently deformable plastic, a non-resiliently deformable polymer, or a steel, which is permanently and/or semi-permanently deformable. The thickness of the sidewall 40 can vary based on a number of factors including the material used. In one embodiment, the sidewall 40 is between 0.010-0.090 inches. In another embodiment, the sidewall 40 is between 0.050-0.200 inches thick. As utilized herein, semi-permanent deformation is defined as a structural state that can be modified from and returned to an original state by an external application of force. In this manner, the sidewall 40 can maintain a deformed state until an assertive action is taken. Thus, plastics or polymers that quickly return to an original state without an external application of force are generally outside the scope of the subject embodiments.

The container 10 includes one or more ribs 70 that can be located at desired locations on the surface of the sidewall 40 of the container 10. In this exemplary embodiment, the ribs 70 are equally circumferentially spaced from each other and extend from the top to the bottom of the body 20. Each rib 70 can be created by crimping, scoring and/or otherwise deforming the sidewall 40 to strengthen the material at each rib 70 location and to facilitate the deformation of the sidewall 40 along straight lines. In this manner, each rib 70 can provide a boundary and breakpoint for edges of a compression in the sidewall 40. In one example, a compression relates to an indentation on the sidewall 40 with a predetermined size, shape, and depth. Such size parameters can be dictated, at least in part, by geometric aspects of the ribs 70 such as score depth, width and shape within the sidewall 40. The compression can be created by the application of force that is external and/or internal relative to the container 10.

The end pieces 30 can be comprised of one or more hoop corrugations 80 that are utilized to reinforce the strength of openings 32 located at either end of the container 10. In particular, the end pieces 30 can include a plurality of hoops coupled together via a flexible material to provide an accordion-like structure. When force is applied to the body 20 (e.g., at each of the ribs 70), the hoop corrugations 80 maintain structural integrity of the openings 32 by isolating the force applied to the body 20. In this manner, the general shape of the openings 32 can be maintained throughout the force application process. The hoop corrugations 80 can include one or more of continuous wave-like ribs, discontinuous ribs that are overlapping, plural, discrete segments that are inclined and overlapping, horizontal segments in rows that overlap, and/or a series of segments that are mutually interfering and overlaid. In this manner, when pressure is applied to the sidewall 40, additional material is provided via the hoop corrugations 80 to facilitate creation of each compression.

The hoop corrugations 80 described herein contemplate substantially any structure located at or near the end pieces 30 of the container 10 to provide strength reinforcement thereof. The hoop corrugations 80 can also be selected based on the size and/or shape of the openings 32, which can have a cross-section that is circular, elliptical, triangular, rectangular, pentagonal, hexagonal, heptagonal, octagonal, nonagonal, decagonal, etc. in accordance with particular embodiments. In this example, the openings 32 are generally circular in shape and have a radius that is substantially the same as the body 20 of the container 10. It is to be appreciated, however, that the openings 32 can have dimensions commensurate with various size and shape of the articles 12, transportation considerations, fabrication material, and other constraints.

In addition, a removable cap (not shown) can be attached to either end piece 30 via known methods of securement. In one example, the removable cap is coupled to only one end piece 30 while the other end piece 30 is permanently attached to cap or equivalent covering component. In another embodiment, removable caps are coupled to both end pieces 30. Securement of caps to the end pieces 30 can be accomplished using any known methods, such as an interference fit, an adhesive, a screw fit, a locking mechanism, etc.

Figure 2:
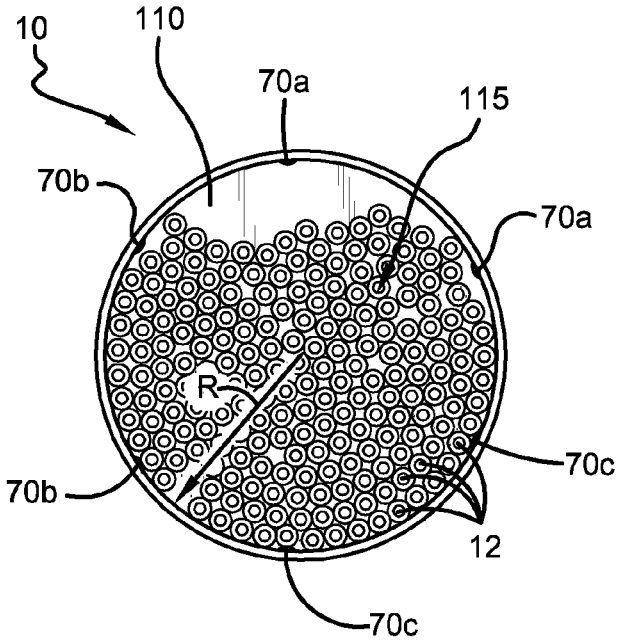
FIG. 2 is an end view of a container with a plurality of articles and a first volume.

FIG. 2 illustrates an end view of the container 10 with articles 12 disposed therein. A plurality of ribs 70 are disposed equidistant from one another around the circumference of the body 20. In this example, there are six ribs 70, which are paired as 70*a*, 70*b*, and 70*c* to create three compressions upon application of appropriate force to the body 20 of the container 10. In one example, force is applied between each pair to create each compression thereby reducing the internal volume of the container 10. A first volume 115 is representative of the amount of space available within the container 10 between planes A and B, as shown in FIG. 1. As the container 10 in this example is generally cylindrical in shape, the first volume 115 can be calculated utilizing a known formula such as $\pi R^2 h$, where R is the radius of the opening 32 and h is the length of the container 10. It is to be appreciated, however, that various formulae can be employed to calculate the first volume 115 value dependent on disparate geometries of container 10.

Figure 3:
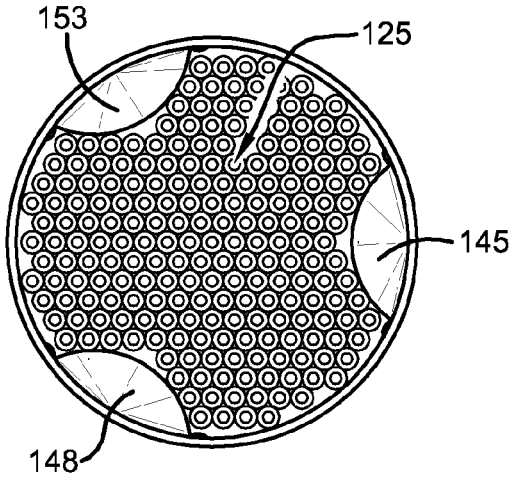
FIG. 3 is an end view of a container that has been compressed to result in a reduced second volume.

FIG. 3 illustrates an end view of the container 10 subsequent to an external application of force to create three compressions 145, 148, and 153 in the sidewall 40. In this example, the container 10 is compressed at three equally spaced locations around the circumference of the container 10 sidewalls (e.g., approximately every 60°) to create compressions 145, 148 and 153 between each rib pair 70*a*, 70*b*, and 70*c* respectively. Such force can be applied prior and/or subsequent to loading of articles 12 (and prior to shipment) to minimize movement thereof during transport. In one example, force is applied prior to loading of the articles 12 to approximate the expected volume occupied thereby. After the articles have been loaded, force can be applied to the container 10 once again to finalize the process and create a packed arrangement within the container 10.

In one aspect, compressions 145, 148 and 153 have an equal radius and depth, which is created by applying a substantially equal predetermined level of external pressure at each location. In one embodiment, the pressure level to create each compression is between 0.2-10 newtons of force. Such pressure level can be commensurate with a known change expected when the sidewall 40 of the container 10 is in contact with one or more articles 12 disposed therein, thickness of the sidewall 40 and/or material used to fabricate the sidewall 40. Thus, once there is an increase in pressure level greater than a particular amount, the operation can end. Once each compression 145, 148, and 153 is created, the container 10 holds a second volume 125, which is smaller than the first volume 115.

Based on the second volume 125, the articles 12 are disposed in a tight packed configuration wherein only a nominal amount of movement is possible. The second volume 125 can be less than the first volume 115 by a desired particular percentage range. In one example, the second volume 125 is around 2-50% less than the first volume 115. In another example, the second volume 125 is 10-30% less than the first volume 115. In yet another example, the second volume 125 is 5-10% less than the first volume 115. In still yet another example, the second volume 125 is 2-8% less than the first volume 115. It is to be appreciated that the second volume 125 can be calculated by subtracting the sum of each compression 145 volume from the first volume 115 using well known geometric principles.

In one example, the size of the compression 145 is determined based on the amount of unused space within the container 10, the strength of the container 10 sidewall 40 material and/or the strength and size of the material of the articles 12. In order to prevent damage to the articles 12, a meter or equivalent (not shown) can be employed in concert with the application of force to continuously monitor pressure applied to the container 10 to insure that it is within a predetermined threshold value. Such threshold value can be related to contact that the internal surface of the sidewall 40 makes with the articles 12 contained within the container 10. In this manner, calibrated and moderated pressure can be employed to secure the articles 12 within the container 10 without causing damage thereof. In one aspect, an optimum compression size can facilitate easy removal of articles 12 subsequent to the application of force (e.g., by an end user).

Figure 4:
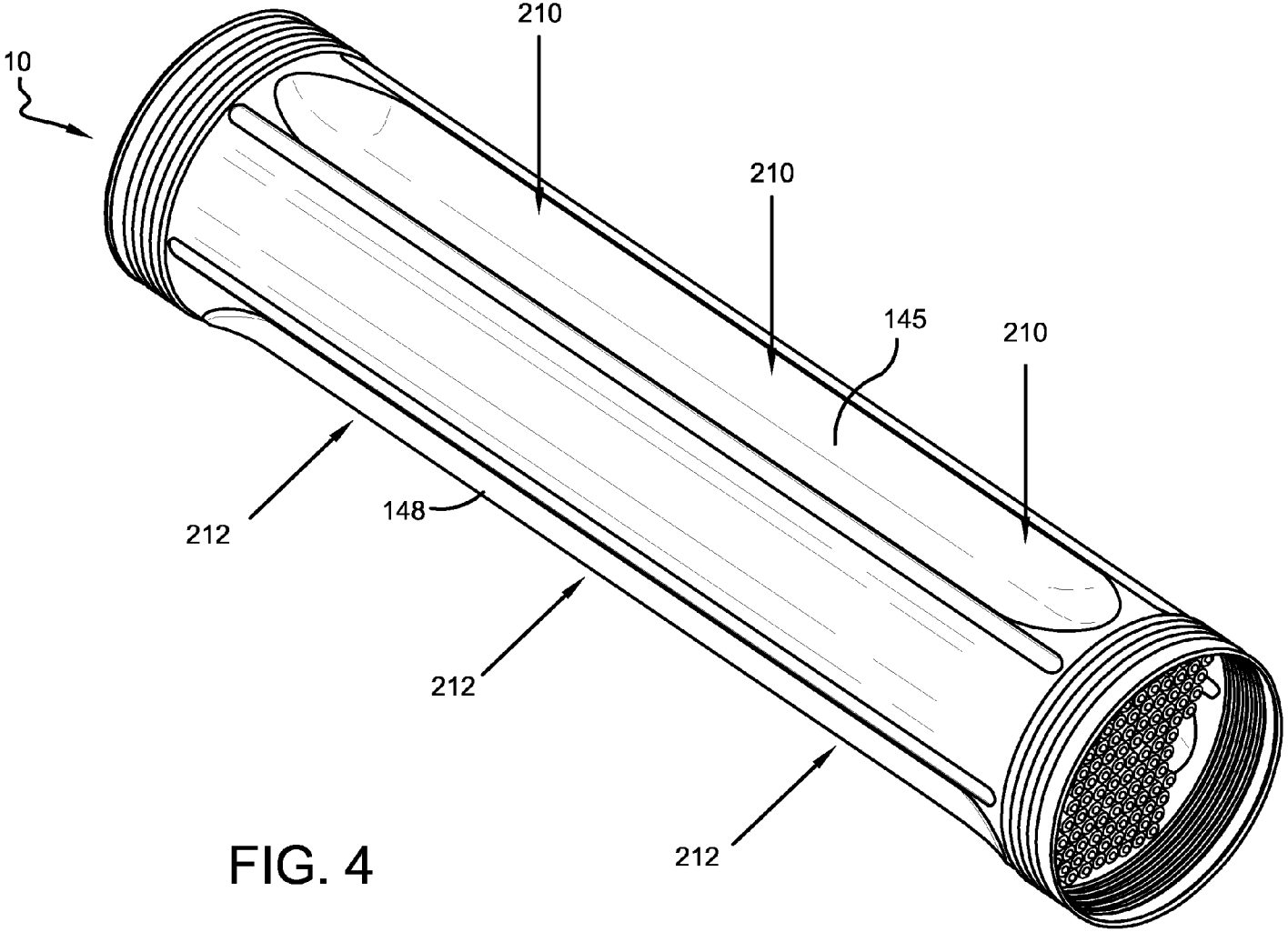
FIG. 4 is a perspective view of a container, wherein pressure is applied from one or more exterior sources.

FIG. 4 shows the container 10 subject to an external forces 210, 212 at three generally equally spaced locations around the circumference of the container 10 to form three compressions including compressions 145 and 148. Although the forces 210, 212 are each illustrated at three discrete locations, it is to be understood that the pressure applied to the sidewall 40 can instead be applied in a relatively homogenous manner to form each compression. In one embodiment, the external force 210 is substantially equal to the external force 212 and a third external pressure (not shown) at each location. In another embodiment, the applied forces are not substantially equal to one another on a compression-by-compression basis. Such pressure values can vary based on a number of factors such as the type and/or quantity of articles 12, the size/shape of the container 10 and the material used for the sidewall 40. The quantity of force applied can be calculated using formulae known to those skilled in the art.

In one embodiment, the external force 210, 212 applied to the container 10 is accomplished via a radial form within a three jawed chuck or similar apparatus. In another example, the force is applied via a press brake, die, or other mechanical implementation known in the art for such purpose. In this example, the chuck can hold three tools, each of which are substantially equal to the desired compression size. In another example, force is applied at a plurality of discrete locations that are equivalent and aligned along respective axes on the container 10. Such discrete force application can be implemented via a plurality of respective tools that each have a footprint equal to some fraction of the surface area of the body 20. Substantially any apparatus, however, is contemplated to apply external force 210, 212 for the creation of compressions 145, 148 at desired locations on the surface of the container 10.

Figure 5:
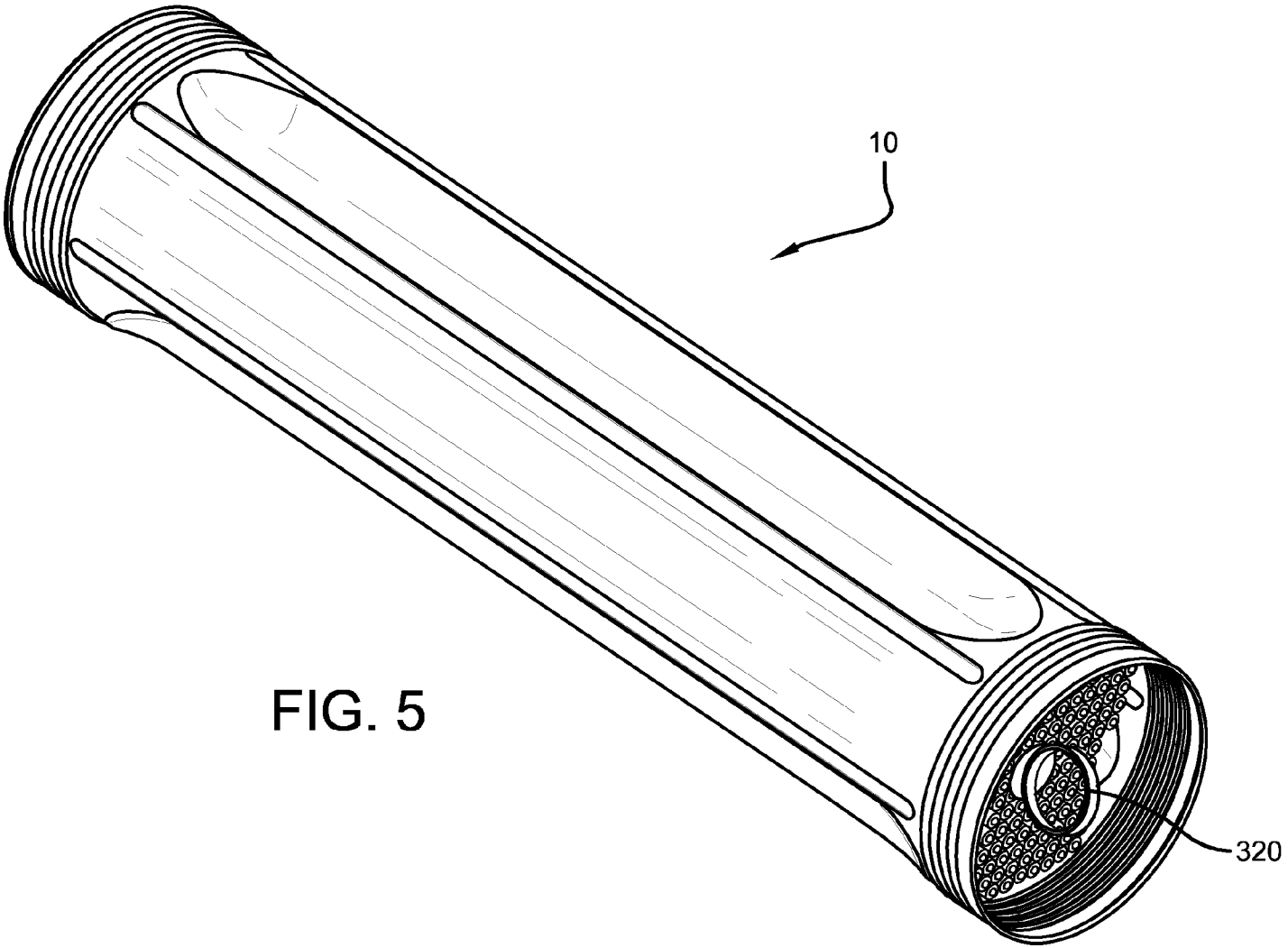
FIG. 5 is a perspective view of a container, wherein an insert is placed within the articles prior to compression.
Figure 6:
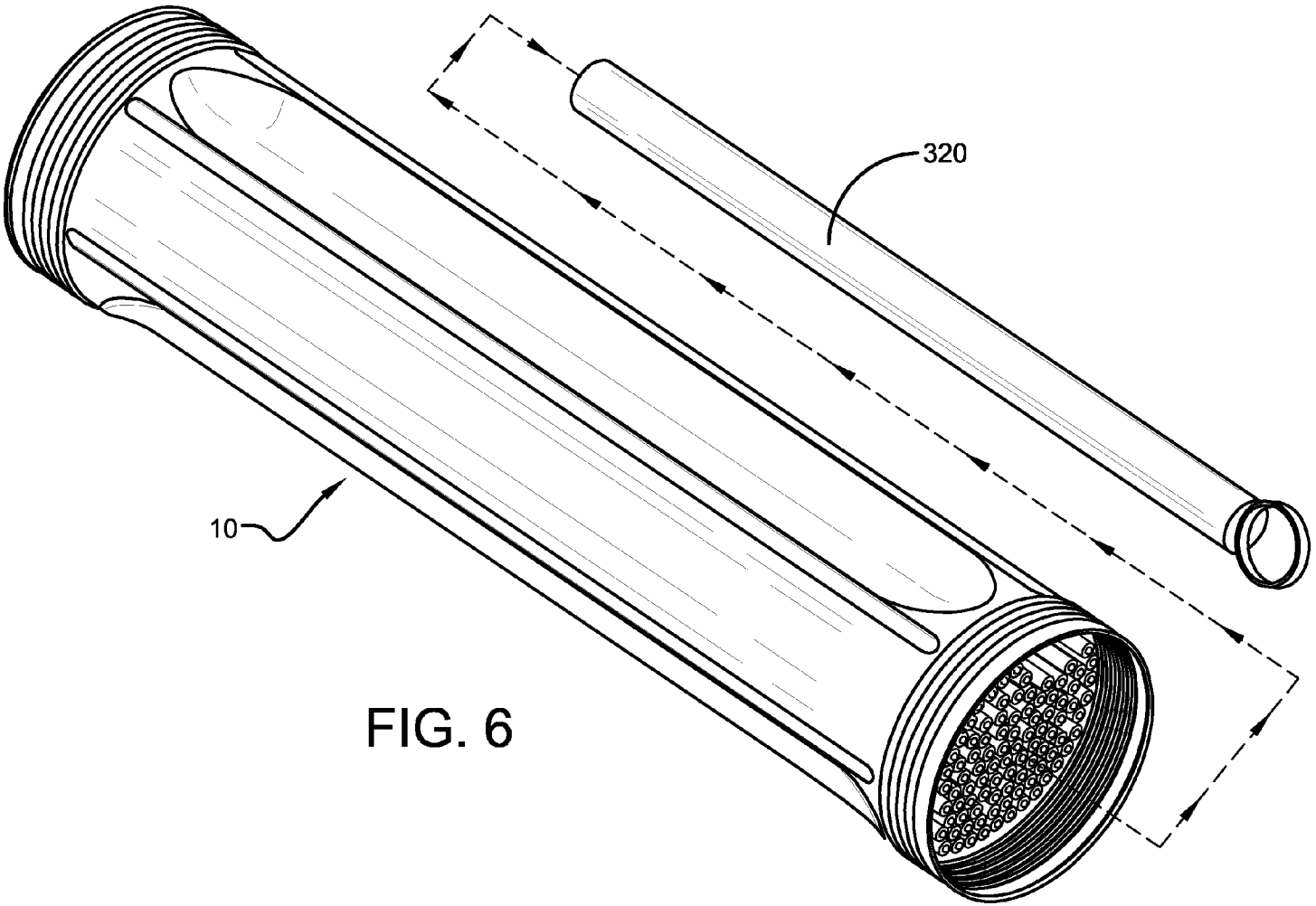
FIG. 6 illustrates a container wherein an insert is removed subsequent to compression to facilitate removal of articles therefrom.

FIG. 5 shows an embodiment wherein an insert 320 is placed into the container 10 prior to application of force. The insert 320 can be utilized subsequently to facilitate the removal of the articles 12 from the container 10 by an end user. In one example, the insert 320 has a rod-like shape and extends substantially the length of the container 10. The insert 320 can be made of a low friction material, such as an ultra-high molecular weight polymer, to facilitate easy removal thereof that does not cause damage to the articles 12. Further, the insert 320 can include a ring or similar structure to extend up from the articles 12 at the opening 32. In this manner, a user can grasp the insert 320 via the structure to pull it from the between the articles 12 and create additional space within the container 10, as illustrated in FIG. 6. Once this is complete, subsequent removal of the articles 12 is straightforward.

Figure 7:
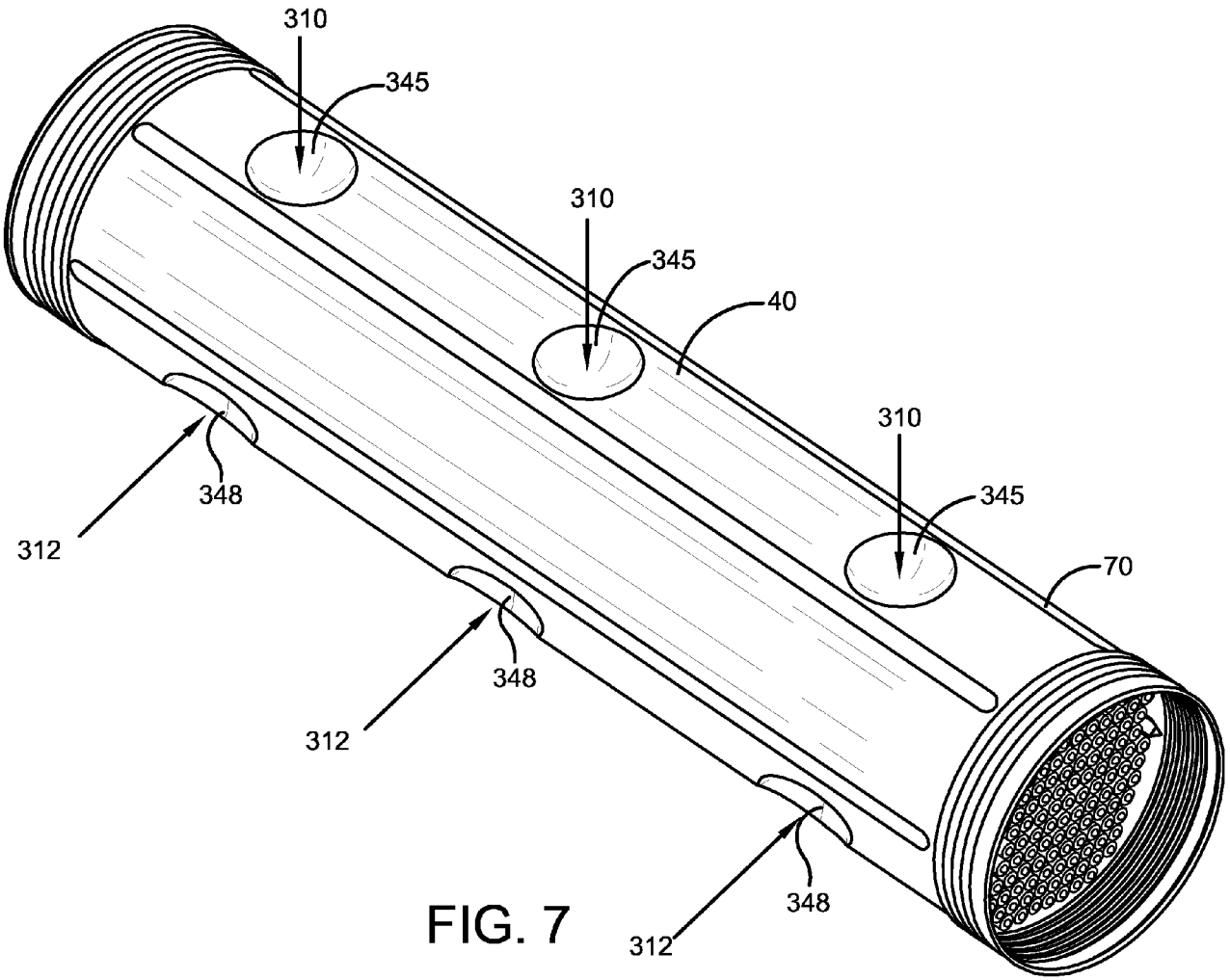
FIG. 7 illustrates a container wherein a plurality of equivalent and aligned dimples are compressed into the container to reduce the internal volume thereof.

FIG. 7 shows an aspect of the subject embodiment wherein a plurality of equivalent and aligned dimples 345, 348 are created on the sidewall 40 of the container 10 via application of force 310, 312 respectively. In one embodiment, the dimples 345, 348 have a rounded cavity and are created along three longitudinal equally spaced locations around the circumference of the container 10. Although three dimples are shown, substantially any number of deformations can be applied within each longitudinal axis. Similarly, the dimples 345 can be substantially any shape. It is to be appreciated that the application of external force 310, 312 can be utilized in a number of ways to modify the internal volume of the container 10 as long as there is symmetry along the length of the articles 12 within the container 10 to allow them to be aligned in a bundle. If a disproportionate number of indentations is utilized on one end of the container 10, the articles 12 can be maligned to prevent the easy removal and/or cause damage to the structure thereof.

Figure 8:
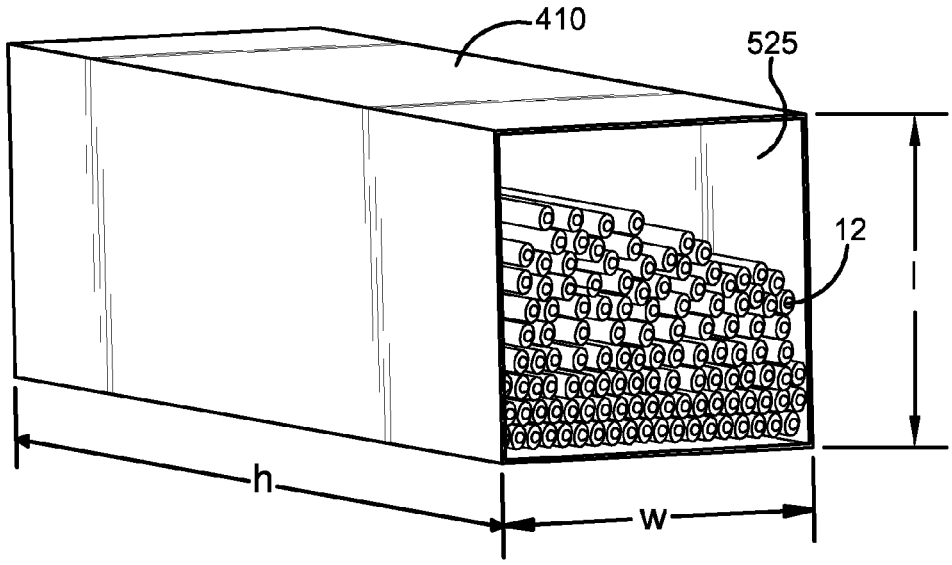
FIG. 8 is a perspective view of a box-like container that contains a plurality of articles.
Figure 9:
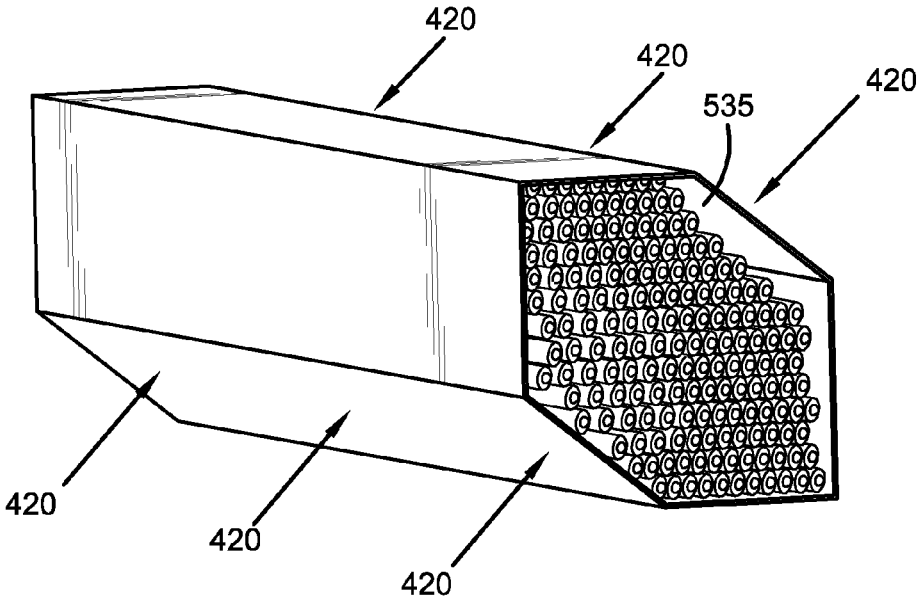
FIG. 9 illustrates the box-like container subject to external compression.

FIGS. 8 and 9 apply the principles described herein to a container 410 that has a box-like shape in contrast to the container 10 which has a cylindrical shape discussed in FIGS. 1-7. Similar to the container 10, the container 410 can be employed to facilitate storage of articles 12 that have a rod-like shape. The container 410 has a first volume 525 prior to any compression operation, which can be calculated as $h \times l \times w$, wherein h is height, l is length, and w is width of the container 410, as shown. FIG. 9 shows the application of external force 420 to the container 410 subsequent to the disposal of articles 12 therein. As discussed above, the force 420 can be applied equally along equivalent and aligned axes on the exterior of the container 10 to ensure that the articles 12 are properly aligned subsequent to the compression operation. In addition, a plurality of dimples or other indentations can be utilized or the use of a single indentation that runs the length of the container 410. The application of force 420 reduces the first volume 525 of the container 410 to a second volume 535. The second volume 535 can be calculated by subtracting the amount of volume lost due to the external force 420 and/or can be calculated utilizing known geometric principles to identify comparative polygon volumes, as applicable.

Figure 10:
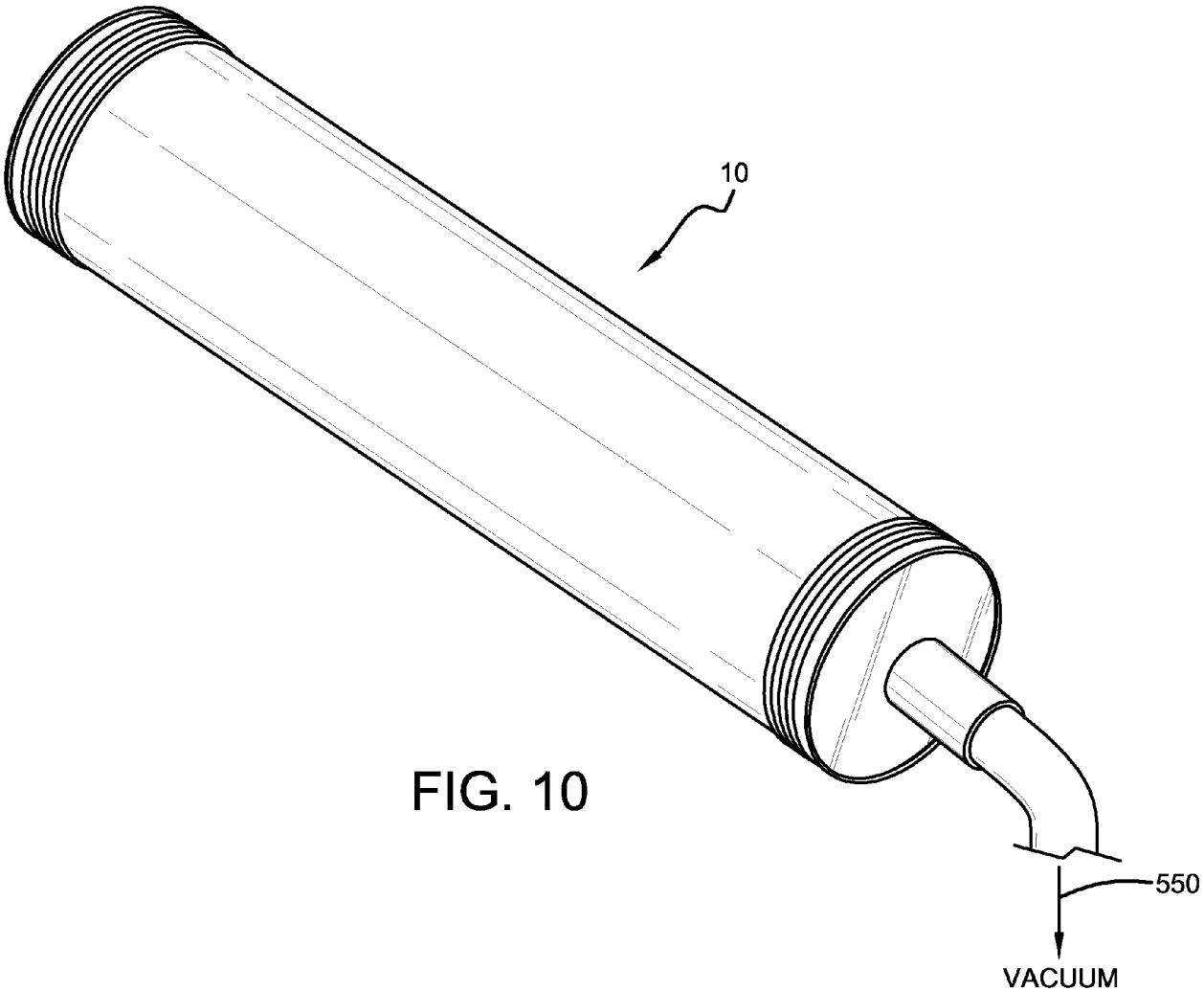
FIG. 10 illustrates a perspective view of a container connected to a vacuum.
Figure 11:
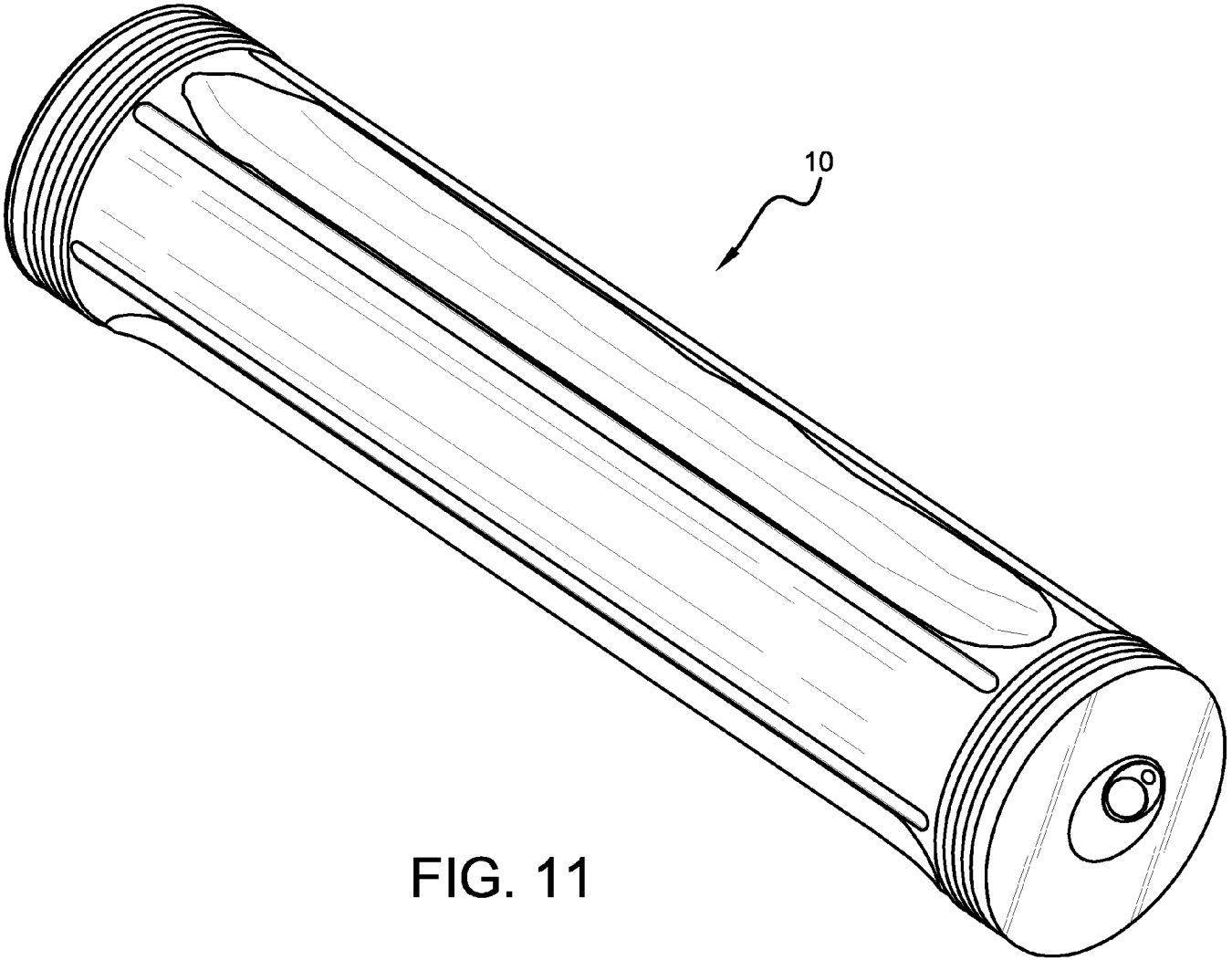
FIG. 11 illustrates a perspective view of a container subsequent to application of a vacuum to reduce internal volume thereof.

FIG. 10 illustrates a vacuum 550 which is applied to the container 10 to facilitate modification of the volume via application of an internal force. In this embodiment, the container 10 can be hermetically sealed to ensure that a substantially zero atmosphere condition is reached to obtain adequate internal force for the creation of compressions on the sidewall 40. This approach can be used in place of or in addition to the application of external force described with regard to FIGS. 1-9. FIG. 11 shows the container 10 subsequent to the drawing of the vacuum 550 wherein the volume of the container 10 is reduced to ensure that the articles 12 do not shift as described with relation to the embodiments herein. A pull tab or similar structure can be couple to an end cap to facilitate opening and return to a substantially original state of the container 10. Once the vacuum seal is broken, air can rush into the container 10 to push the sidewalls 40 in an outward direction. In this manner, the container 10 can return to substantially the volume size prior to application of the vacuum 550.

The invention has been described herein with reference to the preferred embodiment. Obviously, modifications and alterations will occur to others upon a reading and understanding of this specification. It is intended to include all such modifications and alterations insofar as they come within the scope of the appended claims or the equivalence thereof.

The invention claimed is:

1. A container, comprising:

a body comprised of one or more sidewalls drawn in a generally longitudinal fashion;

two compressible end pieces, disposed distally on either end of the container body, said compressible end pieces compressing along a longitudinal axis of said container body; and one or more longitudinally-extending ribs disposed between the end pieces to facilitate inward compression, normal to said longitudinal axis, of the container body between the one or more ribs.

2. The container according to claim 1, wherein the end pieces include hoop corrugations coupled together via a flexible material.

3. The container according to claim 1, further including:

one or more rod-shaped articles disposed within the body of the container; and an end cap coupled to each end piece to encapsulate the one or more rod-shaped articles within the container.

4. The container according to claim 3, wherein the one or more ribs distinguish one or more non-resiliently deformable compressible areas that are created in the body of the container subsequent to insertion of articles therein, the non-resiliently deformable compressible areas reducing the container volume to minimize movement of the rod-shaped articles therein.

5. The container according to claim 4, wherein the one or more compressions are created by applying between about 0.5-10 newtons of force onto the sidewall.

6. The container according to claim 4, wherein the non-resiliently deformable compressible areas are located proximate to the ribs.

7. The container according to claim 1, further including:

a plurality of dimple-shaped compressible areas positioned on an exterior of the container, which upon the application of an force will reduce the internal volume of the container.

8. The container according to claim 7, wherein the dimple-shaped compressions are lined along the body of the container, and wherein two compressions of the plurality of compressions are located proximate to the end pieces and at least one other compression of the plurality of compressions is located substantially equidistant between the two compressions which are located proximate the end pieces.

9. The container according to claim 1, wherein an initial container volume is reduced by 2% to 50%.

10. The container according to claim 1, wherein an initial container volume is reduced by 5% to 8%.

11. The container according to claim 1, wherein the container is compressed via at least one of an external force and a vacuum drawn from the inside of the container.

12. A container to store articles, comprising:

a generally longitudinal body and two end pieces at opposed ends of said body, said body and said end pieces forming a generally unitary sidewall; and one deformation means in the sidewall for allowing compression of said body in a direction normal to a longitudinal axis of said container thereby reducing the internal volume of the container;

and deformation means in the end pieces for allowing longitudinal axial compression of the container at said end pieces.

13. The container according to claim 12, wherein the end pieces include hoop corrugations that substantially mechanically isolate the end pieces from the body.

14. The container according to claim 12, further including:

means for creating a crease in the sidewall to facilitate inward compression of the container body at predetermined boundaries and break points.

* * * * *